US008127402B2

(12) United States Patent
Overgaard

(10) Patent No.: US 8,127,402 B2
(45) Date of Patent: Mar. 6, 2012

(54) ATTACHMENT FOR CLUTCHINGLY COVERING A MAJOR PORTION OF A HANDLE OF A PLUNGER, ENHANCING GRIP OF THE HANDLE OF THE PLUNGER, AND ABSORBING SHOCK FROM REPEATED THRUSTS OF THE PLUNGER

(76) Inventor: Kenneth Overgaard, New York, NY (US)

( * ) Notice: Subject to any disclaimer, the term of this patent is extended or adjusted under 35 U.S.C. 154(b) by 45 days.

(21) Appl. No.: 12/803,175

(22) Filed: Jun. 21, 2010

(65) Prior Publication Data

US 2011/0030173 A1 Feb. 10, 2011

Related U.S. Application Data

(60) Provisional application No. 61/273,710, filed on Aug. 7, 2009.

(51) Int. Cl.
*B25G 1/10* (2006.01)

(52) U.S. Cl. ..... 16/430; 16/426; 4/255.11; 15/143.1

(58) Field of Classification Search ..... 16/421, 16/426, 430, 110.1, DIG. 12; 15/143.1, 145; 81/489; 4/255.11
See application file for complete search history.

(56) References Cited

U.S. PATENT DOCUMENTS

| | | | | |
|---|---|---|---|---|
| 471,932 | A * | 3/1892 | Youngs | 74/551.9 |
| 2,334,057 | A | 11/1943 | Ashton | |
| 3,130,421 | A | 4/1964 | Quinlan | |
| 3,410,017 | A | 11/1968 | Wilson | |
| 3,644,943 | A | 2/1972 | Parodi fu Leonardo | |
| 4,159,115 | A | 6/1979 | Ticktin | |
| 4,878,667 | A | 11/1989 | Tosti | |
| 5,353,442 | A | 10/1994 | Rotter | |
| 5,456,356 | A * | 10/1995 | Kurzawa | 206/349 |
| 5,581,839 | A * | 12/1996 | Ferrell, Jr. | 15/143.1 |
| 5,634,859 | A | 6/1997 | Nesbitt | |
| 6,038,709 | A * | 3/2000 | Kent | 4/255.05 |
| 6,922,854 | B2 * | 8/2005 | Allenbaugh et al. | 4/255.11 |
| 7,017,197 | B1 * | 3/2006 | Williams | 4/255.11 |
| 2006/0123531 | A1 * | 6/2006 | Karlicek | 4/255.11 |
| 2008/0250588 | A1 * | 10/2008 | Robinson et al. | 15/104.05 |
| 2009/0106887 | A1 * | 4/2009 | Dressel | 4/255.11 |
| 2010/0313385 | A1 * | 12/2010 | Brahler et al. | 16/421 |
| 2011/0016621 | A1 * | 1/2011 | Kares | 4/255.11 |

* cited by examiner

*Primary Examiner* — William L. Miller
(74) *Attorney, Agent, or Firm* — Charles E. Baxley

(57) ABSTRACT

An attachment for clutchingly covering a major portion of a handle of a plunger, enhancing grip of the handle of the plunger, and absorbing shock from repeated thrusts of the plunger. The attachment includes an end cap and a sleeve. The end cap covers the free end of the handle of the plunger and absorbs the shock from the repeated thrusts of the plunger. The sleeve depends from the end cap, clutchingly covers the major portion of the handle of the plunger, and enhances the grip of the handle of the plunger.

2 Claims, 3 Drawing Sheets

Figure 1:
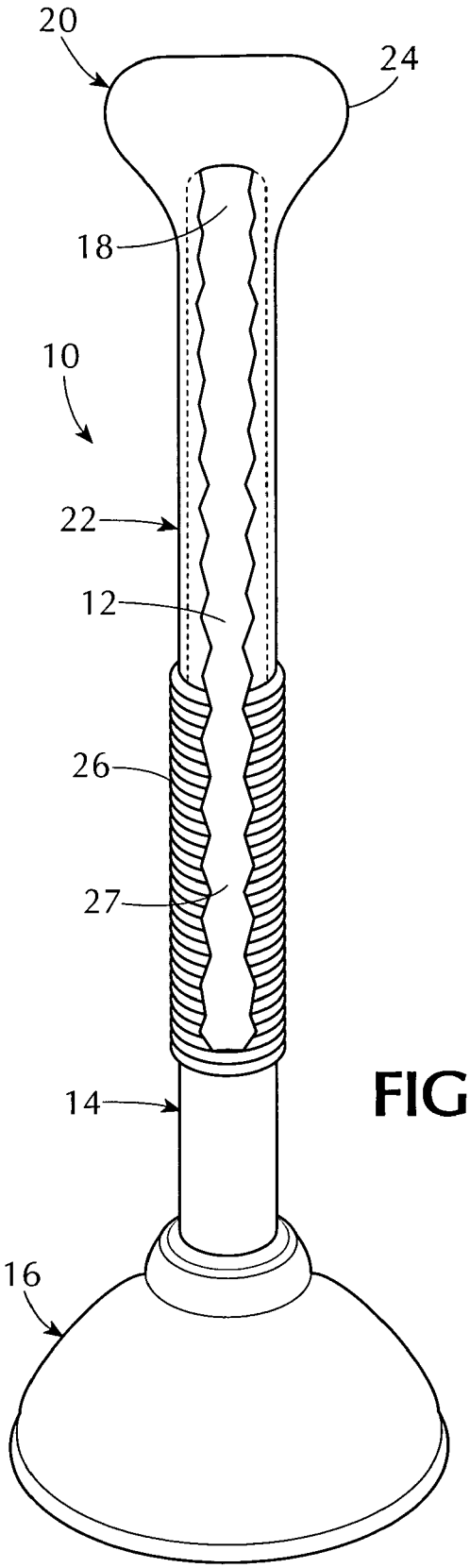

ATTACHMENT FOR CLUTCHINGLY COVERING A MAJOR PORTION OF A HANDLE OF A PLUNGER, ENHANCING GRIP OF THE HANDLE OF THE PLUNGER, AND ABSORBING SHOCK FROM REPEATED THRUSTS OF THE PLUNGER

1. CROSS REFERENCE TO RELATED APPLICATIONS

The instant non-provisional patent application claims priority from provisional patent application No. 61/273,710, filed on Aug. 7, 2009, for a CUSHIONED END CAP AND SLEEVE FOR USE ON A PLUMBER'S SUCTION PLUNGER, and incorporated hereon by reference thereto.

2. BACKGROUND OF THE INVENTION

A. Field of the Invention

The embodiments of the present invention relate to an attachment for a handle of a plunger, and more particularly, the embodiments of the present invention relate to an attachment for clutchingly covering a major portion of a handle of a plunger, enhancing grip of the handle of the plunger, and absorbing shock from repeated thrusts of the plunger.

B. Description of the Prior Art

A plunger is a common device that is used to release stoppages in plumbing. The tool consists of a rubber cup with an attached stick. The cup is pushed down against the drain, and either pressed hard into the drain to force air in, or is pushed down until the rubber cup is flattened and then pulled out causing a vacuum. The intent is to loosen or break up a clog, excessive material, or other blockage in the outlet or drainage pipe from a sink, toilet, bathtub, shower, etc. The difference between a sink plunger and a toilet plunger is that the former looks like a ball cut in half, while the latter looks more like a distorted ball with a large hole on the bottom.

Pressing the cup down hard into the drain until the rubber cup is flattened and then pulling the cup out requires a good grip by both hands of the user on the plunger handle. There is considerable impact on the palm of the user from the repeated thrusts, which causes discomfort to the user's hand. Further, it is difficult to grip the handle of the plunger, which is usually smooth and wet. Thus, there exists a need for an attachment for clutchingly covering a major portion of a handle of a plunger, enhancing grip of the handle of the plunger, and absorbing shock from repeated thrusts of the plunger.

Numerous innovations for grips have been provided in the prior art, which will be described below in chronological order to show advancement in the art, and which are incorporated herein by reference thereto. Even though these innovations may be suitable for the specific individual purposes to which they address, however, they differ from the embodiments of the present invention in that they do not teach an attachment for clutchingly covering a major portion of a handle of a plunger, enhancing grip of the handle of the plunger, and absorbing shock from repeated thrusts of the plunger.

(1) U.S. Pat. No. 2,339,057 to Ashton et al.

U.S. Pat. No. 2,334,057 issued to Ashton et al. on Nov. 9, 1943 in U.S. class 74 and subclass 525 teaches a telescopic handle for hand-actuated machines, which includes a grip to be seized by the operator, and a base member to be directly connected to the element of the machine that is to be actuated and adapted to be transmitted to the same, the forces exerted on the grip. The grip and the base member are connected together by three concentric tubes. The outer and inner of the tubes are rigid with the grip. The intermediary tube is rigid with the base member and adapted to engage slidably the outer tube. A collar is interposed between the end of the intermediary tube and the inner tube. The collar is rigid with the intermediary tube and slidably engages the inner tube. A pin is carried in sockets formed by an outwardly recessed portion of the inner tube, at a point distant from the base member. The pin and the sockets are rigid with the inner tube and slidably engage the intermediary tube. A spring is interposed between a portion of the base member and the sockets. A second pin is rigid with the intermediary tube. Two slots are in the inner tube that are adapted to slidably receive the second-mentioned pin, Two notched recessed portions in the slots are adapted to receive the second mentioned pin whenever the same registers with the recessed portions and the handle is turned.

(2) U.S. Pat. No. 3,130,421 to Quinlan.

U.S. Pat. No. 3,130,421 issued to Quinlan on Apr. 28, 1964 in U.S. class 4 and subclass 255 teaches a plumber's suction plunger including an inverted suction cup of resilient material, which has a relatively thin flexible side wall and an upper wall with a handle connection portion thereon projecting upwardly therefrom. The handle connection portion has an upwardly opening socket therein disposed with its axis substantially vertical. An elongated bent handle has a substantially vertical lower handle portion secured within the socket of the connection portion, and has an upper handle portion disposed at an obtuse angle to the lower handle portion, with the axis of the upper handle portion inclined more nearly to the vertical than to the horizontal. The suction cup has a dome-shaped internal surface defining a suction chamber and extending substantially continuously upwards and inwards from the lower edge of the cup to the axis of the socket. The upper wall of the cup has a passageway there through extending from the suction chamber into the socket. The handle is tubular and has a closure at its upper end defining an elongated handle chamber communicating with the suction chamber through the passageway.

(3) U.S. Pat. No. 3,410,017 to Wilson.

U.S. Pat. No. 3,410,017 issued to Wilson on Nov. 12, 1968 in U.S. class 43 and subclass 22 teaches a removable tubular friction rod grip that may be in one or two parts and which is adapted to cover the reel seat area of the rod and reel mounting portions carried by the rod. The grip also covers the reel base, and has an opening therein to accommodate the reel stem. The grip is particularly adapted for rods provided with spinning reels.

(4) U.S. Pat. No. 3,644,943 to Parodi fu Leonardo et al.

U.S. Pat. No. 3,644,943 issued to Parodi fu Leonardo et al. on Feb. 29, 1972 in U.S. class 4 and subclass 255 teaches a device for clearing blockages in the outlets of sinks, baths, or the like, which includes an elastomeric cup to the base of which is fixed a reciprocable handle. An annular pressing member engages the cup, adjacent the rim, and acts between the rim and the base of the cup or between the rim and the handle to bias the cup to its expanded condition so that in use the rim is held in engagement with the bottom of the bath or the like as the handle is reciprocated.

(5) U.S. Pat. No. 4,159,115 to Ticktin et al.

U.S. Pat. No. 4,159,115 issued to Ticktin et al. on Jun. 26, 1979 in U.S. class 273 and subclass 75 teaches a handle for a racket or the like, which has a first spirally wound strip having flexible resilient stubble members sticking out from the strip, and a second removable, spirally wound, terry-cloth strip anchored to the first strip for providing a moisture-absorbing, firm, handle grip.

(6) U.S. Pat. No. 4,878,667 to Tosti.

U.S. Pat. No. 4,878,667 issued to Tosti on Nov. 7, 1989 in U.S. class 273 and subclass 75 teaches a grip for a golf club, which is readily replaceable without the use of tools to allow changing golf club grips without professional assistance, and is reusable subsequent to replacement since it is not damaged on removal from the golf club shaft.

(7) U.S. Pat. No. 5,353,442 to Rotter.

U.S. Pat. No. 5,353,442 issued to Rotter on Oct. 11, 1994 in U.S. class 4 and subclass 255.11 teaches a plunger utilizing a suction cup. The suction cup is actuated by a lever arm that is operatively connected to the suction cup rod. The device can further contain a splash guard that eliminates splashing or spilling caused by rapid plunger action.

(8) U.S. Pat. No. 5,634,859 to Nesbitt.

U.S. Pat. No. 5,634,859 issued to Nesbitt on Jun. 3, 1997 in U.S. class 473 and subclass 301 teaches a grip including an interior surface and an exterior surface. The interior surface and the exterior surface are essentially coaxial. The grip is fabricated of two layers along its length, namely, an inner layer and an outer layer. The inner layer is fabricated of a relatively hard shore A hardness of between about 70 and 90 and the outer layer is fabricated of a relatively soft shore A hardness of between about 30 and 50. The outer layer and the inner layer are molded together.

It is apparent that numerous innovations for grips have been provided in the prior art, which are adapted to be used. Furthermore, even though these innovations may be suitable for the specific individual purposes to which they address, however, they would not be suitable for the purposes of the embodiments of the present invention as heretofore described, namely, an attachment for clutchingly covering a major portion of a handle of a plunger, enhancing grip of the handle of the plunger, and absorbing shock from repeated thrusts of the plunger.

3. SUMMARY OF THE INVENTION

Thus, an object of the embodiments of the present invention is to provide an attachment for clutchingly covering a major portion of a handle of a plunger, enhancing grip of the handle of the plunger, and absorbing shock from repeated thrusts of the plunger, which avoids the disadvantages of the prior art.

Briefly stated, another object of the embodiments of the present invention is to provide an attachment for clutchingly covering a major portion of a handle of a plunger, enhancing grip of the handle of the plunger, and absorbing shock from repeated thrusts of the plunger. The attachment includes an end cap and a sleeve. The end cap covers the free end of the handle of the plunger and absorbs the shock from the repeated thrusts of the plunger. The sleeve depends from the end cap, clutchingly covers the major portion of the handle of the plunger, and enhances the grip of the handle of the plunger.

The novel features considered characteristic of the embodiments of the present invention are set forth in the appended claims. The embodiments of the present invention themselves, however, both as to their construction and their method of operation together with additional objects and advantages thereof will be best understood from the following description of the specific embodiments when read and understood in connection with the accompanying figures of the drawing.

4. BRIEF DESCRIPTION OF THE FIGURES OF THE DRAWING

Figure 2:
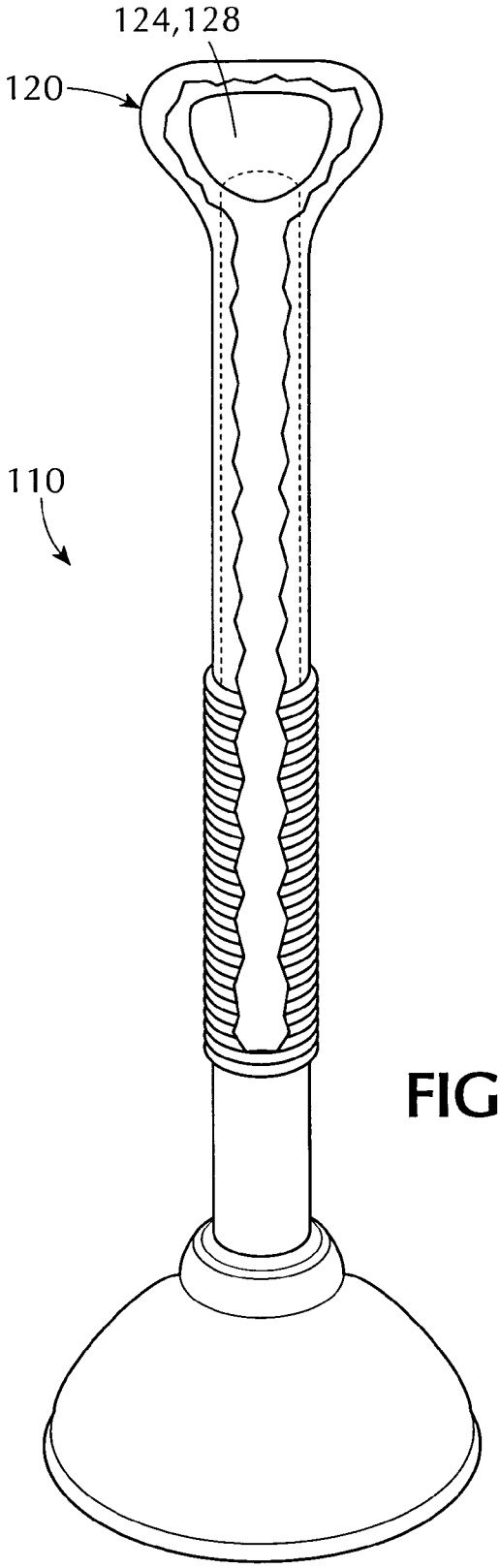
Figure 3:
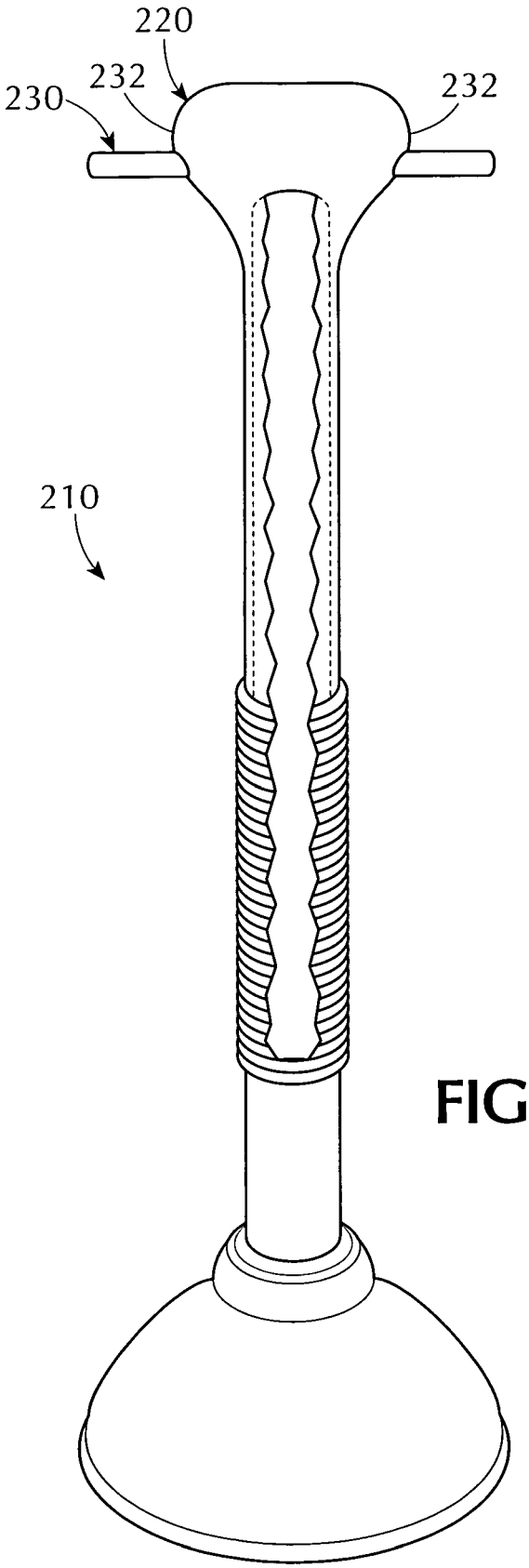

The figures of the drawing are briefly described as follows:

FIG. 1 is a diagrammatic perspective break away view of an embodiment of the attachment of the present invention clutchingly covering a major portion of a handle of a plunger, enhancing grip of the handle of the plunger, and absorbing shock from repeated thrusts of the plunger;

FIG. 2 is diagrammatic perspective break away view of an alternate embodiment of the attachment of the present invention clutchingly covering a major portion of a handle of a plunger, enhancing grip of the handle of the plunger, and absorbing shock from repeated thrusts of the plunger; and FIG. 3 is a diagrammatic perspective break away view of another alternate embodiment of the attachment of the present invention clutchingly covering a major portion of a handle of a plunger, enhancing grip of the handle of the plunger, and absorbing shock from repeated thrusts of the plunger.

5. LIST OF REFERENCE NUMERALS UTILIZED IN THE FIGURES OF THE DRAWING

A. General

10 attachment of embodiments of present invention for clutchingly covering major portion 12 of handle 14 of plunger 16, enhancing grip of handle 14 of plunger 16, and absorbing shock from repeated thrusts of plunger 16
12 major portion of handle 14 of plunger 16
14 handle of plunger 16
16 plunger
18 free end of handle 14

B. Overall Configuration of Attachment 10

20 end cap for covering free end 18 of handle 14 of plunger 16 and absorbing shock from repeated thrusts of plunger 16
22 sleeve for clutchingly covering major portion 12 of handle 14 of plunger 16 and enhancing grip of handle 14 of plunger 16

C. Specific Configuration of Attachment 10

24 cushioning of end cap 20 for absorbing shock from repeated thrusts of plunger 16 to palm of one hand of user that is gripping end cap 20
26 ribbing of sleeve 22 for enhancing grip of other hand of user on handle 14 of plunger 16 during repeated thrusts of plunger 16 when other hand of user grips sleeve 22
27 lower portion of sleeve 22

D. Specific Configuration of Alternate Embodiment of Attachment 110

110 attachment
120 end cap
124 cushioning of end cap 120
128 gas-filled pocket of cushioning 124 of end cap 10

E. Specific Configuration of Another Alternate Embodiment of Attachment 210

210 attachment
220 end cap

230 finger grips for gripping by fingers of one hand of user during repeated thrusts of plunger 16

232 opposite sides of end cap 220

6. DETAILED DESCRIPTION OF THE PREFERRED EMBODIMENTS

A. General

Referring now to the figures, in which like numerals indicate like parts, and particularly to FIG. 1, which is a diagrammatic perspective view of an embodiment of the attachment of the present invention clutchingly covering a major portion of a handle of a plunger, enhancing grip of the handle of the plunger, and absorbing shock from repeated thrusts of the plunger, the attachment of the embodiments of the present invention is shown generally at 10 for clutchingly covering a major portion 12 of a handle 14 of a plunger 16, enhancing grip of the handle 14 of the plunger 16, and absorbing shock from repeated thrusts of the plunger 16. The handle 14 of the plunger 16 has a free end 18.

B. The Overall Configuration of the Attachment 10

The attachment 10 comprises an end cap 20 and a sleeve 22. The end cap 20 is for covering the free end 18 of the handle 14 of the plunger 16 and absorbing the shock from the repeated thrusts of the plunger 16. The sleeve 22 depends from the end cap 20 and is for clutchingly covering the major portion 12 of the handle 14 of the plunger 16 and enhancing the grip of the handle 14 of the plunger 16.

C. The Specific Configuration of the Attachment 10

The end cap 20 and the sleeve 22 are one-piece with each other so as to assure no separation there between during the repeated thrusts of the plunger 16 when one hand of a user grips the end cap 20 and the other hand of the user grips the sleeve 22.

The end cap 20 is bulbous, and has cushioning 24. The cushioning 24 of the end cap 20 is for absorbing the shock from the repeated thrusts of the plunger 16 to the palm of the one hand of the user that is gripping the end cap 20.

The cushioning 24 of the end cap 20 is the material of the end cap 20 being of a cushioning material.

The sleeve 22 has ribbing 26 thereon. The ribbing 26 of the sleeve 22 is for enhancing the grip of the other hand of the user on the handle 14 of the plunger 16 during the repeated thrusts of the plunger 16 when the other hand of the user grips the sleeve 22.

The sleeve 22 has a lower portion 27. The ribbing 26 of the sleeve 22 is on the lower portion 27 of the sleeve 22 for adequately spacing apart the one hand of the user and the other hand of the user during the repeated thrusts of the plunger 16.

D. The Specific Configuration of an Alternate Embodiment of the Attachment 110

The specific configuration of an alternate embodiment of the attachment 110 can best be seen in FIG. 2, which is diagrammatic perspective break away view of an alternate embodiment of the attachment of the present invention clutchingly covering a major portion of a handle of a plunger, enhancing grip of the handle of the plunger, and absorbing shock from repeated thrusts of the plunger, and as such, will be discussed with reference thereto.

The attachment 110 is similar to the attachment 10, except that the cushioning 124 of the end cap 120 is the end cap 120 being of a resilient material and containing a gas-filled pocket 128.

E. The Specific Configuration of Another Alternate Embodiment of the Attachment 210

The specific configuration of another alternate embodiment of the attachment 210 can best be seen in FIG. 3, which is diagrammatic perspective break away view of another alternate embodiment of the attachment of the present invention clutchingly covering a major portion of a handle of a plunger, enhancing grip of the handle of the plunger, and absorbing shock from repeated thrusts of the plunger, and as such, will be discussed with reference thereto.

The attachment 210 is similar to either the attachment 10 or the attachment 110, but with the addition of finger grips 230. The finger grips 230 are rod-like, extend transversely outwardly from opposite sides 232 of the end cap 220, and are for gripping by the fingers of the one hand of the user during the repeated thrusts of the plunger 16.

It is to be understood that the finger grips 230 are usable with either the end cap 20 or the end cap 120.

It is to be further understood that when the finger grips 230 are used with the end cap 120, the finger grips 230 are disposed below the gas-filled pocket 128 so as not to interfere with cushioning effect of the gas-filled pocket 128 on the palm of the one hand of the user.

F. Impressions

It will be understood that each of the elements described above or two or more together may also find a useful application in other types of constructions differing from the types described above.

While the embodiments of the present invention have been illustrated and described as embodied in an attachment for clutchingly covering a major portion of a handle of a plunger, enhancing grip of the handle of the plunger, and absorbing shock from repeated thrusts of the plunger, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. An attachment for clutchingly covering a major portion of a handle of a plunger, enhancing grip of the handle of the plunger, and absorbing shock from repeated thrusts of the plunger, wherein the handle of the plunger has a free end, and wherein said attachment comprises:

a) an end cap; and b) a sleeve;

wherein said end cap is for covering the free end of the handle of the plunger;

wherein said sleeve depends from said end cap;

wherein said sleeve is for clutchingly covering a major portion of the handle of the plunger;

wherein said end cap and said sleeve are one-piece with each other so as to assure no separation there between during the repeated thrusts of the plunger when one hand of a user grips said end cap and the other hand of the user grips said sleeve;

wherein said end cap is bulbous;

wherein said end cap has cushioning, wherein said cushioning of said end cap is said end cap being of a resilient material and containing a gas-filled pocket;

wherein said cushioning of said end cap is for absorbing the shock from the repeated thrusts of the plunger to the palm of the one hand of the user that is gripping said end cap;

wherein said sleeve has ribbing thereon, and wherein said ribbing of said sleeve is for enhancing the grip of the other hand of the user on the handle of the plunger during the repeated thrusts of the plunger when the other hand of the user grips said sleeve;

wherein said sleeve has an upper portion adjacent said end cap and a lower portion; and wherein said ribbing of said sleeve is only on said lower portion of said sleeve for adequately spacing apart the one hand of the user and the other hand of the user during the repeated thrusts of the plunger;

wherein rod-shaped finger grips extend transversely outwardly from opposite sides of said end cap; and wherein said finger grips are arranged for gripping by the fingers of the one hand of the user during the repeated thrusts of the plunger.

2. The attachment of claim 1 wherein said finger grips are disposed below said gas-filled pocket so as not to interfere with cushioning effect of said gas-filled pocket on the palm of the one hand of the user.

* * * * *